United States Patent [19]

Suzuki et al.

[11] 4,447,264

[45] May 8, 1984

[54] PRODUCTION OF MAGNETIC POWDER

[75] Inventors: Shintaro Suzuki; Sadao Iizuka, both of Shibukawa; Yoshimi Moriya, Gunma, all of Japan

[73] Assignee: Kanto Denka Kogyo Co., Ltd., Tokyo, Japan

[21] Appl. No.: 477,010

[22] Filed: Mar. 21, 1983

Related U.S. Application Data

[62] Division of Ser. No. 247,149, Mar. 24, 1981, Pat. No. 4,404,024, which is a division of Ser. No. 18,125, Mar. 7, 1979, Pat. No. 4,306,921.

[30] Foreign Application Priority Data

Mar. 16, 1978 [JP] Japan ..... 53-30151

[51] Int. Cl.[3] ..... B22F 1/00

[52] U.S. Cl. ..... 75/251; 148/31.57; 75/0.5 BA

[58] Field of Search ..... 75/0.5 AA, 0.5 BA, 251; 148/31.55, 31.57

[56] References Cited

U.S. PATENT DOCUMENTS

| | | | |
|---|---|---|---|
| 3,535,104 | 10/1970 | Little et al. | 148/105 |
| 3,679,398 | 7/1972 | Geus | 148/105 |
| 3,837,839 | 9/1974 | Rau et al. | 75/0.5 AA |
| 4,133,676 | 1/1979 | Oshimura et al. | 75/251 |
| 4,306,921 | 12/1981 | Suzuki et al. | 75/0.5 BA |

FOREIGN PATENT DOCUMENTS

| | | | |
|---|---|---|---|
| 2212934 | 9/1973 | Fed. Rep. of Germany | 75/0.5 AA |
| 2212933 | 9/1973 | Fed. Rep. of Germany | 75/0.5 AA |
| 743792 | 1/1956 | United Kingdom . | |
| 1125093 | 8/1968 | United Kingdom . | |
| 1221733 | 2/1971 | United Kingdom . | |
| 1264994 | 2/1972 | United Kingdom . | |
| 1268458 | 3/1972 | United Kingdom . | |
| 1312227 | 4/1973 | United Kingdom . | |
| 1318579 | 5/1973 | United Kingdom . | |
| 1347615 | 2/1974 | United Kingdom . | |
| 1419598 | 12/1975 | United Kingdom . | |

*Primary Examiner*—John P. Sheehan

*Attorney, Agent, or Firm*—Frishauf, Holtz, Goodman & Woodward

[57] ABSTRACT

Acicular magnetic powder consisting essentially of acicular iron particles which have a high coercive force and a high saturation flux density. These particles are doped and additionally contain at least one metal selected from the group consisting of cobalt, nickel, manganese and antimony and are produced in accordance with a process which provides finely divided acicular iron particle products.

7 Claims, No Drawings

PRODUCTION OF MAGNETIC POWDER

This is a division of application Ser. No. 247,149 filed Mar. 24, 1981, which issued as U.S. Pat. No. 4,404,024 on Sept. 13, 1983 which, in turn, is a division of Ser. No. 18,125 filed Mar. 7, 1979, which issued as U.S. Pat. No. 4,306,921 on Dec. 22, 1981.

BACKGROUND OF THE INVENTION

The present invention relates to the production of magnetic powder consisting mainly of iron, particularly to the production of magnetic powder materials which have a high coercive force and saturation flux density desirable for preparing magnetic recording media which are capable of recording signals at a high density.

Hitherto, various magnetic powder materials have been proposed for use in preparing magnetic recording media—for example, $\gamma$-$Fe_2O_3$, Co doped $Fe_2O_3$, $Fe_3O_4$, Co doped $Fe_3O_4$, $Fe_3O_4$-$\gamma$-$Fe_2O$, $CrO_2$ etc. Nowadays, though those skilled in the art still aim at development of recording media which are capable of recording signals at a higher density per unit volume of magnetic material used, it has been found that the conventional materials show a serious defect in the recording of signals of relatively short wavelength. That is their magnetic characteristics such as coercive force (Hc) and flux density ($\sigma$) are insufficient to achieve a high density recording. Therefore, many efforts have been made to find a magnetic material which is suitable for such application. Ferromagnetic metal and alloy materials are thought to be most feasible. It is known that while $\gamma$-$Fe_2O_3$ has usually a saturation flux density on the order of 5,000 gauses, metal materials such as metallic Fe and Fe-Co alloys have a saturation flux density as high as about 20,000 to about 25,000 gauses, four or more times greater than the former. Therefore, if complications that might arise in actual practice are ignored, the metal materials should, theoretically, have about four times the reproducing power obtained with the conventional materials and would enable the production of a recording medium to be used for high density recording.

Some of the various prior art processes proposed for producing ferromagnetic metal or alloy powder materials are listed below:

(1) Process for producing a ferromagnetic metal or alloy by thermal decomposition of a metal salt or salts, typically an oxalic acid salt followed by reduction of the decomposition product with a reducing gas: as described in, for example, Japanese Patent Publication Nos. 11412/61, 22230/61, 8027/65, 14818/66, 24032/67, 22394/68, 38417/72 and 29280/73; Japanese Patent Public Disclosure (KOHKAI) Nos. 38523/72, 22346/73 and 22994/73; U.S. Pat. Nos. 3,186,829 and 3,190,748; Japanese Patent Publication No. 4286/72 (employing phthalate salts).

(2) Process comprising a step of reducing an iron compound for example, selected from iron oxyhydroxide, metal doped-iron oxyhydroxides (e.g. Co doped-oxyhydroxide), iron oxides and ferrite oxides; as described in, for example, Japanese Patent Publication Nos. 3862/60, 11520/62, 20939/64, 29706/72, 30477/72, 39477/72, 24952/73, 7313/74 and 5608/76; Japanese Patent Public Disclosure (KOHKAI) Nos. 5057/71, 7153/71, 79153/73, 82393/73 and 135867/74; U.S. Pat. Nos. 3,598,568 (Klomp et al), 3,607,220 (Vander Giessen et al) and 3,702,270 (Kawasaki et al); U.K. Pat. No. 640,438.

(3) Production of a ferromagnetic metal or alloy by evaporation of a corresponding metal component or components in an inert gas atmosphere: as described in, for example, Japanese Patent Publication Nos. 27718/72, 964/73 and 42780/73; Japanese Patent Public Disclosure (KOHKAI) Nos. 25662/73, 25663,73, 25664/73, 25665/73, 31166/73, 55400/73, 80192/73 and 52134/74.

(4) Production of magnetic metal powder by decomposition of metal carbonyl compounds: as described in, for example, Japanese Patent Publication No. 16868/70, U.S. Pat. Nos. 2,983,997, 3,172,776, 3,200,007 and 3,228,882.

(5) Production of magnetic metal powder by electrolysis of an appropriate metal salt using a mercury cathode followed by removal of mercury entrained in the electrolytic product: as described in, for example, Japanese Patent Publication Nos. 15525/64, 8123/65 and 6007/72 and U.S. Pat. Nos. 3,156,650 and 3,262,812.

(6) Wet reducing of a salt of ferromagnetic metal in solution with a reducing agent such as sodium hypophosphite or sodium borohydride: as described in, for example, Japanese Patent Publication Nos. 20520/63, 26555/63, 20116/68, 9869/70, 7820/72, 16052/72, 41718/72 and 41719/72; Japanese Patent Public Disclosure (KOHKAI) Nos. 1353/72, 42252/72, 42253/72, 7585/73, 25896/73, 44194/73, 79754/73, 82396/73, 28999/73 and 1998/73; and U.S. Pat. Nos. 3,607,218, 3,494,760, 3,535,104, 3,661,556, 3,663,318, 3,669,643 and 3,672,867.

(7) Others, for example a method comprising a step of passing a current impulse through a wire of a magnetic metal placed in vacuo sufficient to cause the wire to be broken into fine powder by discharge-detonation as described in Japanese Patent Publication No. 33857/72.

However, in practice none of these known methods have proved to be commercially feasible.

For example, though the above method (1) which comprises decomposition of a metal salt such as an oxalate has been used for many years, the method usually gives magnetic powder having an average size in the range of 5–10 microns. If such the coarse powder is used for preparing a recording tape, the tape will have a rough surface which results in such disadvantages as a high noise level, difficulty in maintaining intimate contact of the recording surface with the magnetic head of tape recorder, and serious abrasion of the magnetic head. Thus, it is difficult to achieve a satisfactory high density recording with the coarse magnetic material.

The abovementioned method (3) involves a complicated operation and requires expensive apparatus and, thus, from the economic view point the commercial use thereof in a large scale is impractical.

In the abovementioned method (5) comprising electrolysis of a metal salt with a mercury cathode, the product is deposited on the cathode as particles in the form of dendrite containing about 4–6% of mercury. The dendrite particles are heated to remove the mercury. However, it is very difficult fo completely remove the entrained mercury from the product. Further, this process includes a danger of polluting the environment with the mercury. These difficulties are a barrier to the practice of the electrolysis method.

According to the abovementioned method (6), the reduction of a salt or salts in solution will produce a metal or alloy powder which has a highly reactive surface and, thus, is susceptible to oxidation in the presence of oxygen and moisture and eventually may give rise to spontaneous combustion. The powder tends to oxidize slowly even at room temperature and humidity conditions with the consequent deterioration of the desirable magnetic characteristics. The particles of powder obtained by the above method (6) are microscopic fibrils in which individual particles adhere mutually into line. One skilled in the art will appreciate that this type of structure is desirable for the magnetic material. However, when the product is used for the production of recording tape, this characteristic shape is often lost during the stage of admixing the material with a resinous binder to form an uniform suspension. This results in the loss of a large part of the orientation property of the material, resulting in lowering of magnetic characteristics, particularly the square ratio, of the magnetic recording medium prepared therewith.

The present invention relates to improvement of the abovementioned method (2) generally comprising a step of reducing an iron oxyhydroxide or oxide with a reducing gas. Some disadvantages of the prior method (2) have been pointed out. Since in the prior method the reducing treatment is commonly carried out in a hydrogen stream at an elevated temperature, the starting material is subject to reduction in the volume due to the elimination of oxygen, change in the appearance to a porous texture, change in the microstructural shape, and sintering of particles into lumps. Therefore, even if the particles of starting material have a microstructural shape which is desired in the product magnetic powder, in the prior method, it is difficult to achieve desirable magnetic characteristics in the resulting product.

Similar deteriorative phenomena have been found in the conventional production of $\gamma$-$Fe_2O_3$, particularly in an intermediate step thereof in which $\alpha$-$Fe_2O_3$ is converted into $Fe_3O_4$ with gaseous hydrogen by eliminating only 1/9 of oxygen content of the $\alpha$-$Fe_2O_3$. It is said that during said conversion step the material is subject to substantial change in the microstructural shape and sintering of particles.

When a metal is prepared from the oxide, it is expected that the deteriorative phenomena will occur to a much greater extent than in the above $\gamma$-$Fe_2O_3$ production, since substantially all the oxygen content must be removed from the oxide. Thus, the product powder prepared from the oxide will have a low coercive force (Hc) and square ratio, and will not provide a uniform dispersion in a resinous binder composition when used in tape production.

So far as we know the prior method (2) has not yet provided a magnetic powder having characteristics which give satisfactory results in practice. The product metal or alloy powder has a further practical drawback in that it is combustible.

SUMMARY OF THE INVENTION

It is an object of the present invention to dissolve the various difficulties involved in the prior method (2).

Therefore, according to the present invention a magnetic powder is provided in which the initial shape of the micro-particles of the starting material is retained, and the individual particles are not sintered, which has a high coercive force (Hc), square ratio ($\sigma_r/\sigma_s$) and dispersion property and which has low combustibility.

Thus, the present invention provides a process for preparing a magnetic powder suitable for magnetic recording consisting mainly of iron, said process comprising the steps of applying or adsorbing or depositing one or more compounds of Co, Ni, Mn and Sb on a particulate iron oxyhydroxide or oxide material and then reducing the thus treated material with a reducing gas such as hydrogen to form a magnetic powder consisting mainly of iron.

It has been found that iron oxyhydroxides and/or oxides doped with a metal such as Co may be employed advantageously as the starting material according to the invention.

Examples of the starting materials which may be used in the present process include iron oxyhydroxides such as $\alpha$-FeOOH (goethite), $\beta$-FeOOH (akaganite) and $\gamma$-FeOOH (lepidocrocite); iron oxides such as $\alpha$-$Fe_2O_3$, $\gamma$-$Fe_2O_3$, $Fe_3O_4$ and $\gamma$-$Fe_2O_3$-$Fe_3O_4$ (a Berthollide compound); and iron oxyhydroxides and oxides doped with a metal component selected from Co, Mn, Ni, Ti, Bi, Mo, Ag, Cr, Zn, Si and Al and mixtures thereof.

The compounds of Co, Ni, Mn and Sb which may be employed in the process include various soluble and colloid-forming compounds. Examples of the suitable compounds include salts for example, chlorides such as $CoCl_2$, $NiCl_2$ and $SbCl_3$; sulfates such as $CoSO_4$, $NiSO_4$ and $Sb_2(SO_4)_3$; and nitrates. Other suitable examples are hydroxides, partial hydroxides and colloid-forming compounds, for example of the formulae:

$$Co(OH)_xCl_{2-x}$$

wherein x=from 0 (exclusive) to 2 (inclusive), $$Ni(OH)_xCl_{2-x}$$

wherein x=from 0 (exclusive) to 2 (inclusive), $$Mn(OH)_xCl_{2-x}$$

wherein x=from 0 (exclusive) to 2 (inclusive), and $$Sb(OH)_xCl_{3-x}$$

wherein x=from 0 (exclusive) to 3 (inclusive).

Mixtures thereof may also be employed.

Where a water soluble salt is employed, the advantageous effects of the invention may be obtained by treating the starting material merely in a solution of the salt with stirring for a sufficient period of time prior to the reduction stage. However, preferably the so formed dispersion should be treated with an appropriate acid or alkali to neutralize the dispersion completely or partly so that the salt is converted into an oxide or hydroxide which is deposited or precipitated to form a coat on the surface of material. Where the salt is alkaline in the solution, of course an acid such as hydrochloric, sulfuric, phosphoric or nitric acid is used, while where the salt is acidic, an alkali such as sodium hydroxide, potassium hydroxide or ammonia is employed for this purpose.

It will be appreciated that a surfactant such as sodium oleate or sodium alginate may advantageously be used in the treatment to obtain a stable uniform dispersion resulting in desirable magnetic properties.

The amount of the metal component applied on the starting material is suitably in the range of from about 1% to about 10% by weight (as expressed as the initial compound) on the basis of the weight of Fe present in the starting material. Where two or more metal compounds are used, similarly the total amount applied is suitably about 1-10% by weight. As the amount of metal component used increases, the magnetic characteristics of the product powder become lower due to a dilution effect thereof. However, an amount up to about 20% may be used according to the process.

Then the thus treated material carrying the added metal component is reduced under a hydrogen atmosphere at a temperature up to 600° C., preferably up to 500° C. Though the lower limit of the reducing temperature is not critical, in practice of the process temperatures below 200° C. will not be employed because it prolongs the reaction time. Preferably a temperature higher than 250° C. is used, though a temperature as low as down to 200° C. may be used, if desired.

After the reducing stage, the powder consisting mainly of iron is preferably stabilized with a stream of mixture of nitrogen and air. Preferably the content of air in the mixture is increased stepwise or gradually from a few percent to about 100% as the stabilization proceeds. For example, in each of the attached Examples, after the reduction, a vessel containing a reduced product was cooled and then initially a mixture of 99% nitrogen and 1% air was passed through for about 30 minutes and continuously a series of mixtures were passed with increasing the air content respectively two-fold at substantially the same intervals as the above for a total period of time of about 4 to 5 hours and finally the stream was switched to pure air prior to removal of the product from the vessel.

The present magnetic powder may be used in any of the conventional methods for preparing magnetic recording media such as recording tape.

DESCRIPTION OF THE PREFERRED EMBODIMENT

The present invention will be further illustrated with reference to the following Examples which are intended to show the preferred embodiments but not to limit the scope of the invention.

Copending Japanese Patent Application No. 51795/76 (corresponding to Japanese Patent Public Disclosure (KOHKAI) No. 134828/77) assigned to the same assignee describes a process for producing a magnetic powder which differs from the present process in that the starting material is treated with an aluminium compound and/or a silicon compound prior to the reducing stage. It will be appreciated that the combination of the above process and the present process may provide an improved magnetic material.

Copending Japanese Patent Application No. 30150/78 which corresponds to U.S. application Ser. No. 18,115, filed Mar. 7, 1979, which issued as U.S. Pat. No. 4,274,865 on June 23, 1981 assigned to the same assignee describes a process for producing magnetic powder which differs from the present process in that the starting material is treated with at least one of compounds of Zn, Cr and Cu. The process may also be combined with the present process to provide an improved magnetic material.

EXAMPLE 1

Acicular α-FeOOH powder (80 g) was suspended in about 6 liters of water with mechanical stirring for about 10 minutes to give a dispersion. To the dispersion, 50 ml of a 1 mol/l solution of nickel chloride were added dropwise and stirred more for 10 minutes. Then 50 ml of 1 N NaOH solution were added to the dispersion over a period of approximately 30 minutes with stirring. After the addition of NaOH, the dispersion was stirred further for about 30 minutes. Then the mixture was filtered to give a wet cake, which was dried at about 150° C. overnight.

A sample (10 g) of the dried cake was reduced with a stream of $H_2$ gas at a rate of 3 liters/min. at 350° C. for about 7 hours to yield a magnetic powder of a Ni content of 5 molar % on the basis of Fe present therein. The powder was subjected to a stabilizing treatment with a series of nitrogen-air mixtures of increasing air content as hereinbefore mentioned.

The following magnetic characteristics were obtained:

| | | |
|---|---|---|
| $H_c$ (coercive force) | 898 | Oe(oerstead) |
| $\sigma_r$ (residual flux density) | 48.8 | emu/g |
| $\sigma_s$ (saturation flux density) | 122 | emu/g |
| $\sigma_r/\sigma_s$ (square ratio) | 0.40 | |

EXAMPLE 2

The procedure of Example 1 was repeated except that acicular Co doped-γ-$Fe_2O_3$ powder (about 88 g; Co 4 wt %/Fe) was used instead of the FeOOH. The product magnetic powder showed the following characteristics:

| | | |
|---|---|---|
| $H_c$ | 1,120 | Oe |
| $\sigma_r$ | 54.1 | emu/g |
| $\sigma_s$ | 132 | emu/g |
| $\sigma_r/\sigma_s$ | 0.41 | |

EXAMPLE 3

Acicular α-FeOOH powder (80 g) was added into 6 liters of water and stirred for about 10 minutes to give a dispersion. To the dispersion, 50 ml of a 1 mol/l solution of cobalt chloride were added dropwise and stirred further for about 10 minutes. Then, 75 ml of a 1 N NaOH solution were added to the dispersion over a period of about 30 minutes. Thereafter, the dispersion was stirred more for about 30 minutes. Then the mixture was processed as in Example 7 to give a magnetic powder of a Co content of about 5 molar % on the basis of Fe. The characteristics were:

| | | |
|---|---|---|
| $H_c$ | 1,125 | Oe |
| $\sigma_r$ | 55.4 | emu/g |
| $\sigma_s$ | 135 | emu/g |
| $\sigma_r/\sigma_s$ | 0.41 | |

EXAMPLE 4

The procedure as described in Example 1 was repeated except that acicular α-$Fe_2O_3$ powder (88 g) was used in place of the α-FeOOH. The product magnetic powder had the following characteristics:

| | | |
|---|---|---|
| $H_c$ | 1,044 | Oe |
| $\sigma_r$ | 50.7 | emu/g |
| $\sigma_s$ | 130 | emu/g |
| $\sigma_r/\sigma_s$ | 0.39 | |

EXAMPLE 5

Acicular α-FeOOH powder (80 g) was suspended in 6 liters of water and uniformly dispersed using a stirrer for about 10 minutes. To the suspension, 50 ml of a 1 mol/l solution of antimony chloride were added dropwise and stirred further for about 10 minutes. Then, 75 ml of a 1 N NaOH solution was added over a period of about 30 minutes. Thereafter, the mixture was treated as in Example 1 to give a powder having a Sb content of about 3 molar % (based on Fe).

| | |
|---|---|
| $H_c$ | 850 Oe |
| $\sigma_r$ | 50 emu/g |
| $\sigma_s$ | 125 emu/g |
| $\sigma_r/\sigma_s$ | 0.40 |

EXAMPLE 6

Acicular α-FeOOH powder (80 g) was suspended in 6 liters of water and dispersed uniformly using a stirrer for about 10 minutes. To the dispersion, 50 ml of a solution of 1 mole of manganese chloride per liter were added dropwise. Then the dispersion was treated as in Example 1 to give a magnetic powder of a Mn content of 5 molar % (based on Fe). The following characteristics were achieved.

| | |
|---|---|
| $H_c$ | 980 Oe |
| $\sigma_r$ | 56.6 emu/g |
| $\sigma_s$ | 138 emu/g |
| $\sigma_r/\sigma_s$ | 0.41 |

EXAMPLE 7

Acicular α-$Fe_2O_3$ powder (88 g) was suspended in 6 liters of water and dispersed uniformly using a stirrer for about 10 minutes. To the dispersion, a mixture of 25 ml of a solution of 1 mol/l of cobalt chloride and 25 ml of a solution of 1 mol/l of nickel chloride was added dropwise and stirred further for about 10 minutes. Then, 50 ml of a 1 N NaOH solution were added to the dispersion over a period of about 30 minutes. Thereafter, the mixture was treated as described in Example 1 to give a magnetic powder having a Co content of about 2 molar % and a Ni content of about 2 molar % (based on Fe).

The characteristics were:

| | |
|---|---|
| $H_c$ | 1,120 Oe |
| $\sigma_r$ | 54.9 emu/g |
| $\sigma_s$ | 134 emu/g |
| $\sigma_r/\sigma_s$ | 0.41 |

COMPARATIVE EXAMPLE 1

Acicular α-FeOOH powder as used in the preceding Examples 1, 3, 5 and 6 was processed by a procedure similar to that as described in Example 1 except that no metal compound was applied to the starting material according to the present invention. In the thus produced powder, the particles were found to have crumbled undesirably and to have sintered to a significant extent. Consequently the product had the following poor characteristics:

| | |
|---|---|
| $H_c$ | 531 Oe |
| $\sigma_r$ | 24.8 emu/g |
| $\sigma_s$ | 124 emu/g |
| $\sigma_r/\sigma_s$ | 0.20 |

COMPARATIVE EXAMPLE 2

Acicular α-$Fe_2O_3$ as used in the preceding Examples 5 and 7 was processed by a procedure similar to that of Example 1 except that no metal compound was applied to the starting material. In the product powder, the particles were found to have crumbled and to have sintered significantly. The product showed the following poor characteristics:

| | |
|---|---|
| $H_c$ | 420 Oe |
| $\sigma_r$ | 21.5 emu/g |
| $\sigma_s$ | 113 emu/g |
| $\sigma_r/\sigma_s$ | 0.19 |

COMPARATIVE EXAMPLE 3

Acicular Co doped-γ-$Fe_2O_3$ as used in Example 2 was processed by a procedure similar to that of Example 1 except that no metal compound was applied to the starting material. In the thus produced powder, the magnetic particles crumbled and sintered. The following magnetic characteristics were obtained.

| | |
|---|---|
| $H_c$ | 580 Oe |
| $\sigma_r$ | 26.9 emu/g |
| $\sigma_s$ | 128 emu/g |
| $\sigma_r/\sigma_s$ | 0.21 |

We claim:

1. Acicular magnetic powder consisting essentially of acicular iron particles having a high coercive force and a high saturation flux density, said particles being doped with at least one metal selected from the group consisting of Co, Mn, Ni, Ti, Bi, Mo, Ag, Cr, Zn, Si and Al and additionally containing an applied metal selected from the group consisting of cobalt, nickel, manganese and antimony and mixtures thereof, said iron particles having been produced in accordance with the process comprising (a) treating finely divided starting material in the form of acicular particles selected from the group consisting of (i) a doped iron oxyhydroxide containing a doping component selected from the group consisting of Co, Mn, Ni, Ti, Bi, Mo, Ag, Cr, Zn, Si, Al and mixtures thereof and (ii) a doped iron oxide containing a doping component selected from the group consisting of Co, Mn, Ni, Ti, Bi, Mo, Ag, Cr, Zn, Si, Al and mixtures thereof with an aqueous solution or suspension of an applied metal compound selected from the group consisting of cobalt, nickel, manganese and antimony compounds and mixtures thereof or a mixture of said solution and said suspension so that said applied metal compound is applied on said particles, (b) filtering said treated particles from the liquid medium to form a cake comprising said treated particles and drying said cake and, (c) reducing said dry cake in a reducing gas stream at a temperature up to 600° C. to reduce said treated particles of doped iron oxyhydroxide or doped iron oxide containing said applied metal compound whereby the individual particles are not sintered and the initial shape of the micro-particles of the starting material is retained to form said acicular magnetic powder.

2. The magnetic powder of claim 1 wherein said applied metal is cobalt.

3. The magnetic powder of claim 1 wherein said applied metal is nickel.

4. The magnetic powder of claim 1 wherein said applied metal compound which is applied on said particles is in an amount from about 1% to about 10% by weight based on the iron content of said particles.

5. The magnetic powder of claim 2 wherein said applied metal compound which is applied on said particles is in an amount from about 1% to about 10% by weight based on the iron content of said particles.

6. The magnetic powder of claim 3 wherein said applied metal compound which is applied on said particles is in an amount from about 1% to about 10% by weight based on the iron content of said particles.

7. The magnetic particles of claim 1 wherein said acicular magnetic powder consisting essentially of acicular iron particles is stabilized.

* * * * *